United States Patent [19]

Schöyer H. F. R. et al.

[11] Patent Number: 4,938,814

[45] Date of Patent: Jul. 3, 1990

[54] HIGH-PERFORMANCE PROPELLANT COMBINATIONS FOR A ROCKET ENGINE

[75] Inventors: Schöyer H. F. R., Zoetermeer; P. A. O. G. Korting, Uwintsheul; J. M. Mul, Delft, all of Netherlands

[73] Assignee: European Space Agency, Paris, France

[21] Appl. No.: 376,844

[22] Filed: Jul. 7, 1989

[30] Foreign Application Priority Data

Jul. 8, 1988 [NL] Netherlands ..... 8801739

[51] Int. Cl.[5] ..... C06B 45/10

[52] U.S. Cl. ..... 149/19.9; 149/22; 149/36; 149/88

[58] Field of Search ..... 149/22, 19.9, 36, 88

[56] References Cited

U.S. PATENT DOCUMENTS

| | | | |
|---|---|---|---|
| 3,345,821 | 10/1967 | Magee | 60/214 |
| 3,704,184 | 11/1972 | Kuehl, et al. | 149/1 |
| 3,730,783 | 5/1973 | Pilipovich et al. | 198/285 |
| 3,862,864 | 4/1975 | Flynn et al. | 149/20 |
| 3,995,559 | 12/1976 | Bice et al. | 149/15 |

OTHER PUBLICATIONS

Dadieu et al., Raketentreibstoffe, pp. 109–112, 638, 675–676 Springer-Verlag (1968).

Greleci, et al., A.R.S. Journal, 32(8), 1189–95 (1962) (especially) 1190–92).

Haberman, Chemical Engineering Progress, 68(7), 72–76 (1964).

Urbanski, Chemistry and Technology of Explosives, vol. 4, pp. 568–573 Pergamon Press, (1985).

*Primary Examiner*—Stephen J. Lechert, Jr.

*Attorney, Agent, or Firm*—Michael N. Meller

[57] ABSTRACT

Hybrid, high-performance propellant combinations for a rocket engine are described, characterized by being constituted by a combination of polyglycidyl axide (GAP) ($[C_3H_5N_3O]_n$), poly-3,3-bis(azidomethyl)oxetane (BAMO) ($[C_4H_6N_6O]_n$) or hydroxy-terminated polybutadiene (HTPB) with hydrazinium nitroformate ($N_2H_5C(NO_2)_3$) as a solid oxidizer and pentaborane ($B_5H_9$) or diborane ($B_2H_6$) as a fuel, together with other conventional additives.

2 Claims, No Drawings

HIGH-PERFORMANCE PROPELLANT COMBINATIONS FOR A ROCKET ENGINE

This invention relates to propellant combinations for a rocket engine. More specifically, the invention relates to a propellant combination having a high performance and which, prior to use, can be stored for a considerable time.

There is a great need for high-performance propellants which, whether or not in combination, can be stored for a considerable time, for example, in a spacecraft, and can be used not only to change the position of a spacecraft which is in space, but also for launching a spacecraft into space.

Storable combinations of propellants of the prior art, generally consisting of an oxidizer component and a fuel component, have performances inferior to those of conventional, cryogenic combinations.

Thus the specific impulse (Isp) of a rocket engine fed with a combination of dinitrogen tetroxide ($N_2O_4$) and monomethylhydrazide ($N_2H_3CH_3$) is approximately 3000 m/sec, whereas cryogenic mixtures of liquid oxygen and hydrogen offer a specific impulse of more than 4000 m/sec.

The effect of specific impulse on spacecraft payload capabilities is dramatic. If, for example, a velocity of 2000 m/sec is required for bringing a spacecraft into orbit, or for changing a given orbit, then with a specific impulse of 2943 m/sec, half of the spacecraft launch mass would consist of propellant. Raising the specific impulse to 4415 m/sec would reduce the propellant mass to 37.5%. As the mass of the propulsion system itself would not have to be changed appreciably, this freely available mass of 12.5% could be used completely for orbiting means of telecommunication etc. For a spacecraft of 2000 kg, this means an increase in payload by 250 kg.

The invention is based on the proposition of developing a propellant combination that can be stored for a prolonged period of time prior to use and is capable of providing a specific impulse which is at least equal to, or exceeds that obtainable by known combinations. The search was directed in particular to hybrid propellant combinations.

The combustion pressure and expansion ratio between the throat and the mouth of the nozzle ($_{At}^{Ae}$) for present, (pressure-fed) rocket engines are (approximately) as follows:

| Propellant | Combustion pressure MPa | Expansion ratio |
|---|---|---|
| liquid | 1 | 125 |
| solid | 10 | 100 |
| hybrid | 1 | 125 |

For new rocket engines to be developed, a (pump-fed) combustion chamber pressure of 15 MPa and an expansion ratio of 750 are foreseen.

The search for the novel combinations was carried out with particular regard to the above operating conditions.

As is well known, the theoretical performance of a propellant or propellant combination can generally be expressed by the following formula:

$$Isp = \sqrt{2\gamma \cdot (\gamma - 1)^{-1} \cdot R_o \cdot T_c \cdot M^{-1} \left[ 1 - \left( \frac{Pe}{Pc} \right)^{\frac{\gamma - 1}{\gamma}} \right]}$$

where $\gamma$ is the specific heat ratio, $_{Cv}^{Cp}$,

Ro is the universal gas constant, $T_c$ is the flame temperature,

M is the mean molar mass of combustion products, $P_c$ is the combustion chamber pressure, and $P_e$ is the nozzle exit pressure.

This equation shows that the specific impulse is directly proportional to the square root of the chamber temperature and inversely proportional to the square root of the mean molecular mass of the combustion products, while the $_{Cv}^{Cp}$ ratio also effects the specific impulse.

The combustion chamber temperature is primarily determined by the energy released during the combustion of the propellant components and the specific heat of the combustion products:

$$T_c = \frac{\Delta H}{C_p}$$

Because $$\frac{C_p}{C_v} = \frac{C_v \frac{R_o}{M}}{C_v} = \frac{C_p}{C_p - \frac{R_o}{M}}$$

the most important parameters affecting the performance of the propellant are M, $C_p$ and $\Delta H$.

One of the specific objects of the present invention is to provide a hybrid propellant combination, the use of which leads to the combination of these parameters having an optimum value while neither the starting materials, nor the reaction products involve inacceptable risks for men and the enviornment.

The hybrid propellant combination according to the invention is constituted by a combination of polyglycidyl azide ($[C_3H_5N_3O]n$), or poly-3,3-bis(azidomethyl-)oxetane ($[C_4H_6N_6O]n$) or hydroxy-terminated polybutadiene, all with hydrazinium nitroformate ($N_2H_5C(NO_2)_3$) and with pentaborane ($B_5H_9$) as a fuel.

The compounds referred to will also be designated by the following acronyms hereinafter:

| | |
|---|---|
| Dinitrogen tetroxide | NTO |
| Tetranitromethane | TNM |
| Polyglycidyl azide | GAP |
| Poly 3,3-bis(azidomethyl)oxetane | BAMO |
| Hydrazinium nitroformate | HNF |
| Nitronium perchlorate | NP |
| Ammonium perchlorate | AP |
| Hydroxy-terminated polybutadiene | HTPB |
| Monomethylhydrazine | MMH |

The proportions of the components, i.e. oxydizer and fuel component, in the propellant combinations according to this invention are not critical. Generally speaking, the components are mixed with each other prior to the reaction in such proportions that the mixing ratios are around the stoichiometric ratio. In the hybrid propellant combinations according to the invention, good results are obtained with a quantity of no more than 10%, calculated on the total mixture, of the (energetic) binder (HTPB, GAP or BAMO). The above amounts of binder can provide adequate mechanical strengths.

Preferred hybrid propellant combinations according to the invention are the following:

$N_2H_5C(NO_2)_3$ (61%) + $B_5H_9$ (29%) + HTPB (10%)

$N_2H_5C(NO_2)_3$ (55%) + $B_5H_9$ (35%) + GAP or BAMO (10%).

Generally speaking, minor proportions, specifically up to no more than a few percent by weight, of substances such as nitrogen monoxide, phthalates, stearates, copper or lead salts, carbon black etc., are added to the propellant combinations according to the invention. These additives are known to those skilled in the art and serve to increase stability, keeping characteristics and combustion characteristics, etc. of the propellant as well as to promote their anti-corrosion properties.

The propellant combinations according to the invention are stored prior to use, using known per se techniques, with the individual components, oxydizer and fuel component generally being in separate tanks or combustion chamber.

The propellant combinations according to the invention are distinct from known combinations by their high performance, as evidenced by the following table.

By means of a computer calculation (cf. S. Gordon and B.J. McBride, Computer Program for Calculation of Complex Chemical Equilibrium Compositions, Rocket performance, Incident and Reflected Shocks, and Chapman-Jouguet Detonations, NASA SP-273, Interim Revision, March 1976) and using the thermodynamic data of the reactants and reaction products (cf. D.R. Stull and H. Prophet, JANAF Thermochemical Tables, Second Edition, NSRDS-NBS 37, 1971 and JANAF supplements; I. Barin, O Knacke and O. Kubaschewski, Thermochemical properties of inorganic substances, Springer-Verlag, 1977) the performances of the propellant combinations were verified. Calculations were made for both chemical equilibrium (ef) and for a "frozen flow" condition in space after the combustion chamber (ff). The values obtained are summarized in the following Table 1.

TABLE 1

Theoretical maximum specific impulses and specific impulses at equal tank volumes (oxidizer/fuel) for some liquid and hybrid combination according to the invention. The specific impulse shown is 92% of the known value. Percentages are by weight.

| Type | Oxidizer | Fuel | $P_c$ (MPa) | $A_e/A_t$ (−) | Tank vol. ratio oxidizer/fuel | max. $I_{sp}$ (m/s) | | equal $I_{sp}$ tank vol. (m/s) | | max. gain[2] in $I_{sp}$ (m/s) | | gain in $I_{sp}$ at eg. tank vol. (m/s)[2] | |
|---|---|---|---|---|---|---|---|---|---|---|---|---|---|
| | | | | | | ef | ff | ef | ff | ef | ff | ef | ff |
| Liquid | 71% $N_2O_4$ | 29% MMH[1] | 1 | 125 | 1.49 | 3203.4 | 2849.7 | 3097.5 | 2947.5 | 0 | 0 | 0 | 0 |
| Liquid | 71% $N_2O_4$ | 29% MMH[1] | 15 | 750 | 1.49 | 3376.7 | 3069.7 | 3225.2 | 3110.8 | 0 | 0 | 0 | 0 |
| Hybrid | 61% HNF | 29% $B_5H_9$ 10% HTPB | 1 | 125 | — | 3302.6 | 3022.4 | — | — | 99.2 | 172.7 | — | — |
| Hybrid | 55% HNF | 35% $B_5H_9$ 10% GAP | 1 | 125 | — | 3336.2 | 3079.6 | — | — | 132.8 | 229.9 | — | — |

[1]Liquid reference propellant.
[2]Compared with reference propellant.

It is noted that the substances constituting the components of the propellant combinations according to the invention, and some of which are known per se as a propellant component, have been described in the literature as regards both their preparation and their chemical and physical properties.

In this connection particular reference is made to the following publications:

B. Siegel and L. Schieler, Energetics of Propellant Chemistry, J. Wiley & Sons Inc., 1964.

S. F. Sarner, Propellant Chemistry, Reinhold Publishing Corporation, 1966.

R.C. Weast, Handbook of Chemistry and Physics, 59th Edition, CRC press, 1979.

A. Dadieu, R. Damm and E. W. Schmidt, Raketentreibstoffe, Springer-Verlag, 1968.

G. M. Faeth, Status of Boron Combustion Research, U. S. Air Force Office of Scientific Research, Washington D.C. (1984).

R. W. James, Propellants and Explosives, Noyes DATA Corp., 1974.

G. M. Low and V. E. Haury, Hydrazinium nitroformate propellant with saturated polymeric hydrocarbon binder, U.S. Pat. No. 3,708,359, 1973.

K. Klager, Hydrazine perchlorate as oxidizer for solid propellants, Jahrestagung 1978, 359–380.

L. R. Rothstein, Plastic Bonded Explosives Past, Present an Future, Jahrestagung 1982, 245–256.

M. B. Frankel and J. E. Flanagan, Energetic Hydroxyterminated Azido Polymer, U.S. Pat. No. 4,268,450, 1981.

G. E. Manser, Energetic Copolymers and method of making some, U.S. Pat. No. 4,483,978, 1984.

M. B. Frankel and E. R. Wilson, Tris (2 -axidoehtyl) amine and method of preparation thereof, U.S. Pat. No. 4,449,723, 1985.

What we claim is:

1. A hybrid propellant combination for a rocket engine, comprising a combination of polyglycidyl azide (GAP) ($[C_3H_5N_3O]n$), poly-3,3-bis(azidomethyl)oxetane (BAMO) ($[C_4H_6N_6O]n$) or hydroxyterminated polybutadiene (HTPB) with hydrazinium nitroformate ($N_2H_5C(NO_2)_3$) as a solid oxidizer and pentaborane ($B_5H_9$) or diborane ($B_2H_6$) as a fuel.

2. A hybrid propellant combination as claimed in claim 1, selected from the group consisting of:

$N_2H_5C(NO_2)_3$ (61%) + $B_5H_9$ (29%) + HTPB (10%), and $N_2H_5C(NO_2)_3$ (55%) + $B_2H_9$ (35%) + GAP or BAMO (10%).

* * * * *